US008297164B1

(12) United States Patent
Mensch

(10) Patent No.: US 8,297,164 B1
(45) Date of Patent: Oct. 30, 2012

(54) REMOTELY OPERABLE MACHINE GUN CHARGING APPARATUS

(75) Inventor: Russell D. Mensch, Caddo Mills, TX (US)

(73) Assignee: Contract Fabrication and Design, LLC, Princeton, TX (US)

( * ) Notice: Subject to any disclaimer, the term of this patent is extended or adjusted under 35 U.S.C. 154(b) by 0 days.

(21) Appl. No.: 13/111,343

(22) Filed: May 19, 2011

Related U.S. Application Data

(60) Provisional application No. 61/370,869, filed on Aug. 5, 2010.

(51) Int. Cl.
*F41A 7/06* (2006.01)

(52) U.S. Cl. ..... 89/1.4

(58) Field of Classification Search ..... 89/1.4, 89/148, 9, 11
See application file for complete search history.

(56) References Cited

U.S. PATENT DOCUMENTS

| | | | | | |
|---|---|---|---|---|---|
| 2,413,416 | A | * | 12/1946 | Ostlund et al. | 89/1.4 |
| 2,767,615 | A | * | 10/1956 | Hardy | 89/1.4 |
| 2,773,425 | A | * | 12/1956 | Weeks | 89/1.4 |
| 3,427,925 | A | * | 2/1969 | Horn | 89/136 |
| 4,966,063 | A | * | 10/1990 | Sanderson et al. | 89/37.22 |
| 4,974,499 | A | * | 12/1990 | Sanderson et al. | 89/1.4 |

* cited by examiner

*Primary Examiner* — Michael Carone
*Assistant Examiner* — John D Cooper
(74) *Attorney, Agent, or Firm* — Haynes and Boone, LLP

(57) ABSTRACT

A remotely operable machine gun charger is provided for selectively controlling the forward-to-rear movement of a machine gun bolt pin. When the bolt pin is released from its safe position the charger permits the bolt pin to be spring-driven back to its armed position substantially instantaneously by the bolt spring without waiting for pin engagement and drive structure portions of the gun to be returned to their forwardmost positions. The charger permits the gun to be fired during such movement of the engagement and drive structure back to their forwardmost positions, and the charger may be mounted on and removed from the machine gun without the use of tools, or the necessity of removing or adjusting any of the internal components of the machine gun.

18 Claims, 16 Drawing Sheets

REMOTELY OPERABLE MACHINE GUN CHARGING APPARATUS

CROSS-REFERENCE TO RELATED APPLICATION

This application claims the filing benefit of U.S. Provisional Application Ser. No. 61/370,869 filed on Aug. 5, 2010, such provisional application being incorporated herein by reference in its entirety.

BACKGROUND OF THE INVENTION

In the past, various types of charging apparatus have been used in conjunction with machine guns to selectively move the machine gun's bolt pin between a forwardly disposed "armed" position in which the gun is ready to fire, and a rearwardly disposed "safe" position in which firing of the gun is prevented until the bolt pin is returned to its armed position. U.S. Pat. No. 4,974,499 to Sanderson et al, which is hereby incorporated herein by reference, illustrates and describes an electrically driven machine gun charging system which is representatively utilized in conjunction with a 0.50 caliber machine gun and comprises an actuating member which is drivable between first and second positions. The actuating member, during driven movement toward its second position, engages the bolt pin of the machine gun and drives it rearwardly to its safe position, against the biasing force of its associated return spring when the actuating member reaches its second position.

Electric drive means are provided and are selectively operable to drive the actuating member in opposite directions between its first and second positions. Latch means operate to engage and releasably hold the bolt pin in its safe position in response to movement of the actuating member to its second position. The latch means are further operative to hold the bolt pin in its safe position during electrically driven return movement of the actuating member from its second position to its first position. Release means, operative in response to driven return movement of the actuating member to its first position, cause the latch means to be disengaged from the bolt pin to permit the bolt pin to be rapidly moved, by its return spring, forwardly from its safe position to its armed position.

While this previously utilized gun charging system has proven to be well suited for its intended purpose, it has several limitations and disadvantages. For example, to remove the charging system from the gun, and then replace it or mount a new charging system on the gun requires removal of and subsequent replacement of certain internal components of the gun, thereby complicating charging system service or replacement. Additionally, the return of the bolt pin from its safe position to its armed position (at which point the gun can be fired) is delayed until the actuation member is electrically driven from its rearwardly disposed second position clear back to its forwardly disposed first position. This undesirably delays firing of the gun when its bolt pin is in its safe position. Further, the charging system, which has numerous parts, is relatively complex, large and heavy.

It would be desirable to provide an improved machine gun charging system which eliminates or at least substantially minimizes these limitations and disadvantages associated with the above-described conventional gun charging system. It is to this goal that the present invention is primarily directed.

DETAILED DESCRIPTION

Figure 1:
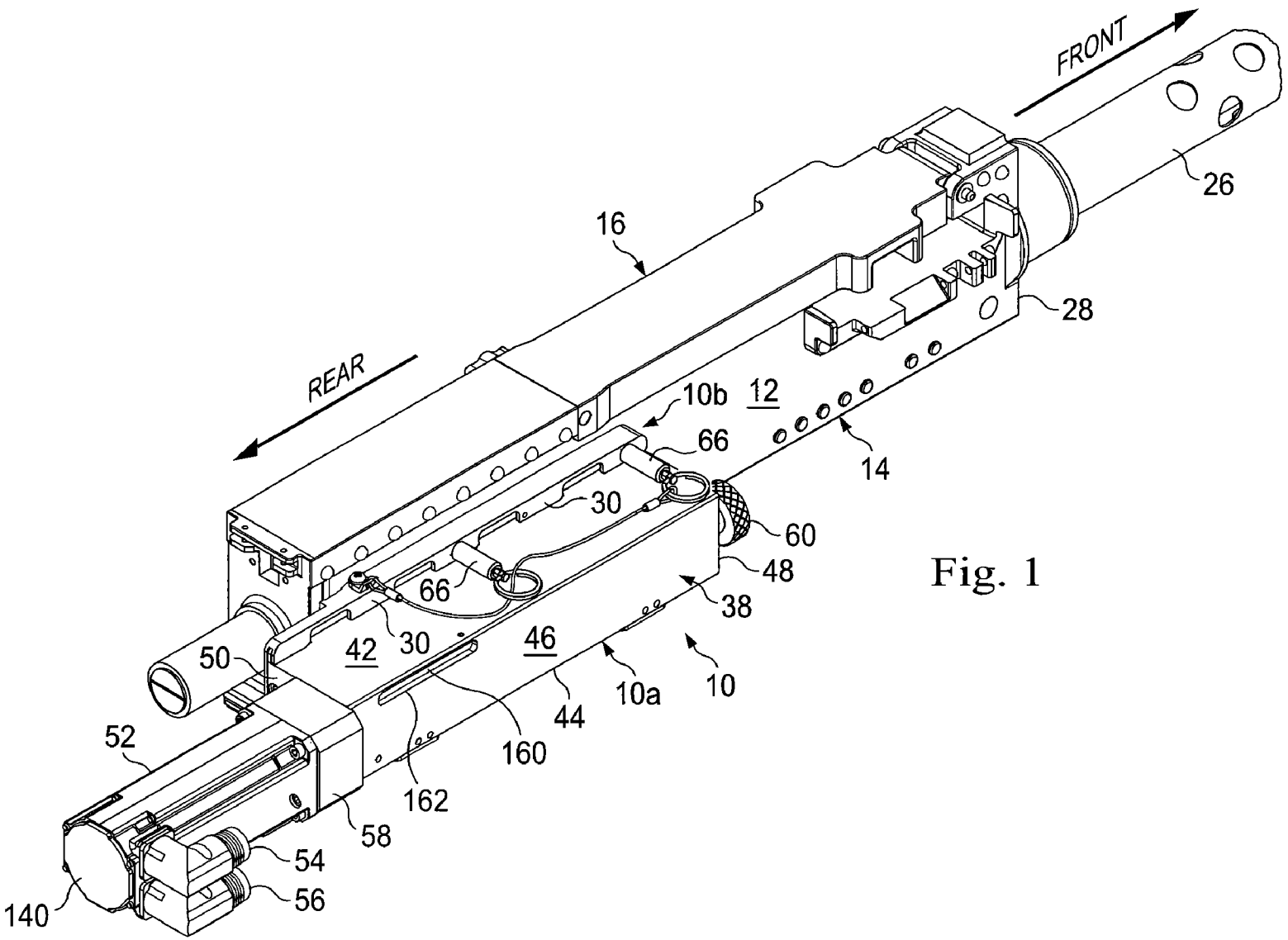
FIG. 1 is a perspective view of a representative machine gun upon which is operatively mounted a specially designed remotely operable gun charger embodying principles of the present invention.
Figure 2:
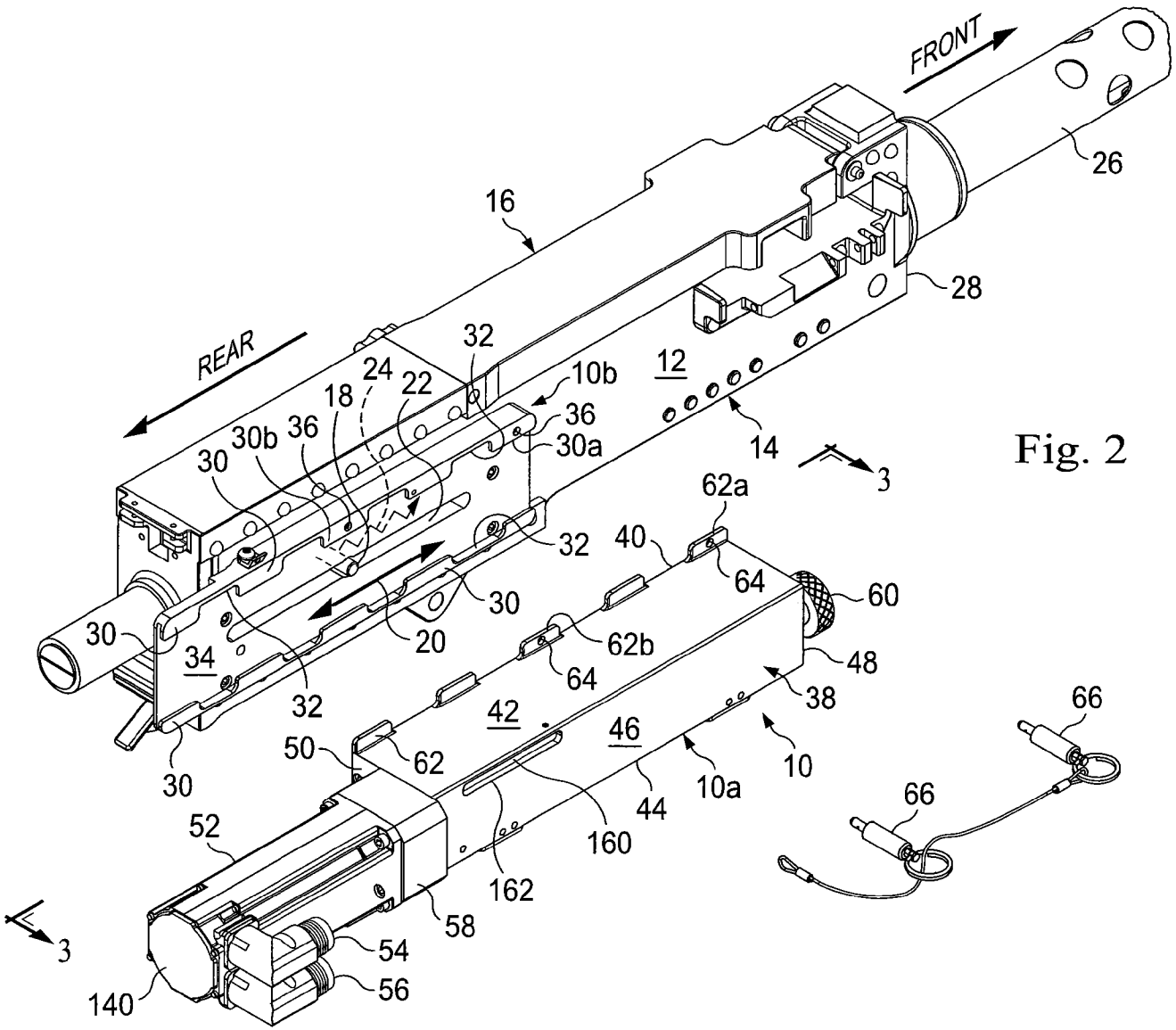
FIG. 2 is a partially exploded view similar to that in FIG. 1, but with the charger housing and its internal components removed from a gun-supported mounting plate portion of the charger.

With initial reference to FIGS. 1 and 2, the present invention provides a specially designed charger 10, having body portion 10*a* and a mounting plate portion 10*b*, which may be operatively mounted on a side wall 12 of the body 14 of a machine gun, representatively a 0.50 caliber machine gun 16 (see FIG. 1), and remotely operated to selectively move the bolt pin 18 of the machine gun (see FIG. 2) forwardly and rearwardly, as indicated by the double-ended arrow 20 in FIG. 2, between "armed" and "safe" positions as later described herein. Bolt pin 18 projects outwardly through a horizontally elongated slot 22 in the mounting plate 10*b* which is screwed to the machine gun body side wall 12, the bolt pin 18 being forwardly biased by a bolt return spring 24 disposed within the machine gun body 14 and shown in phantom in FIG. 2. As shown in FIGS. 1 and 2, the barrel 26 of the machine gun 16 extends forwardly from the front end 28 of the machine gun body 14. While the charger 10 is illustratively associated with a 0.50 caliber machine gun, it will be readily appreciated by those of skill in this particular art that it could also be utilized in conjunction with other types of machine gun if desired.

For purposes later described herein, positioned along the top and bottom edges of the mounting plate 10*b* are series of vertically inwardly projecting tabs 30 interdigitated with vertical notches 32, the tabs 30 being outwardly spaced apart from the generally planar body 34 of the mounting plate 10*b*. Mounting holes 36 are formed in upper tabs 30*a* and 30*b*.

Figure 5:
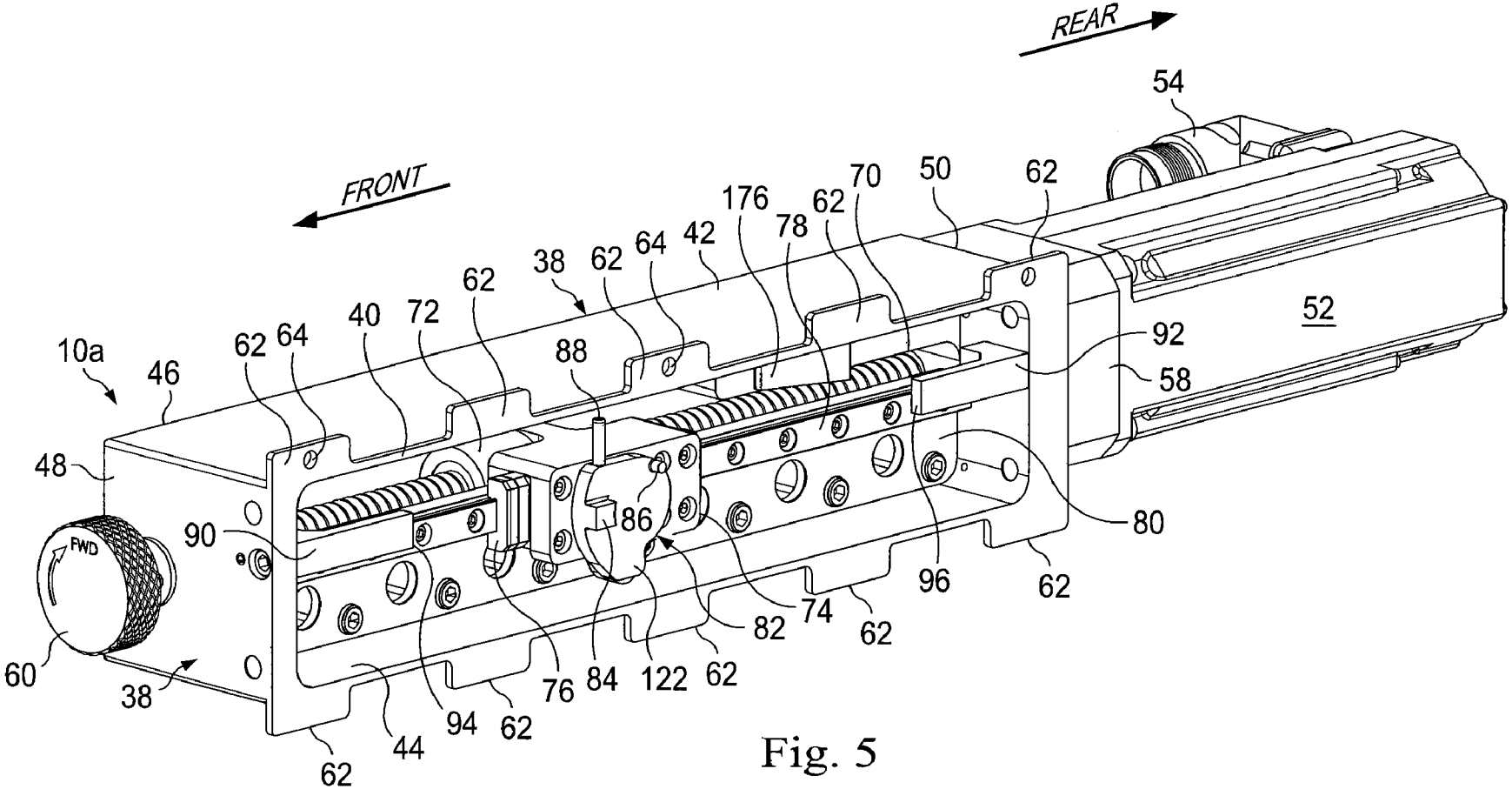
FIG. 5 is an inner side perspective view of the removed gun charger portion shown in FIG. 2.

Turning now to FIGS. 2 and 5, the charger body portion 10*a* includes a horizontally elongated hollow rectangular housing 38 having an open inner side 40, a top wall 42, a bottom wall 44, an outer side wall 46, a front end wall 48, and a rear end wall 50. An electric drive motor 52, having secured thereto a resolver connector 54 and an electric power connector 56, is mounted on the front body end wall 50 by means of a motor adapter member 58. For purposes later described herein, an adjustment knob 60 projects outwardly from the front body end wall 48 and is rotatably secured thereto.

Spaced series of mounting tabs 62 project upwardly and downwardly from the top and bottom side walls of the charger body portion housing 38 at the open inner side 40 thereof, with upper tabs 62*a* and 62*b* having mounting holes 64 formed therein. The tab and notch arrays on the facing sides of the charger body portion 10*a* and mounting plate portion 10*b* advantageously permit the charger portions 10*a* (including the various subsequently described charger operating components disposed within housing 38) and 10*b* to be rapidly mated and uncoupled, to thereby facilitate charger removal and repair or replacement without the use of tools or the necessity of removing, adjusting or otherwise accessing any parts within the machine gun 16. To install the charger body portion 10*a* on the mounting plate portion 10*b* (see FIG. 2), all that is necessary is to move body tabs 62 into mounting plate notches 32 and then horizontally move body tabs 62*a*,62*b* into underlying alignment with mounting plate tabs 30*a*,32*b*, and then insert ball pins 66 into the aligned tab openings 64 and 36. Subsequent removal of the body portion 10*a* is achieved simply by reversing these steps.

Figure 6:
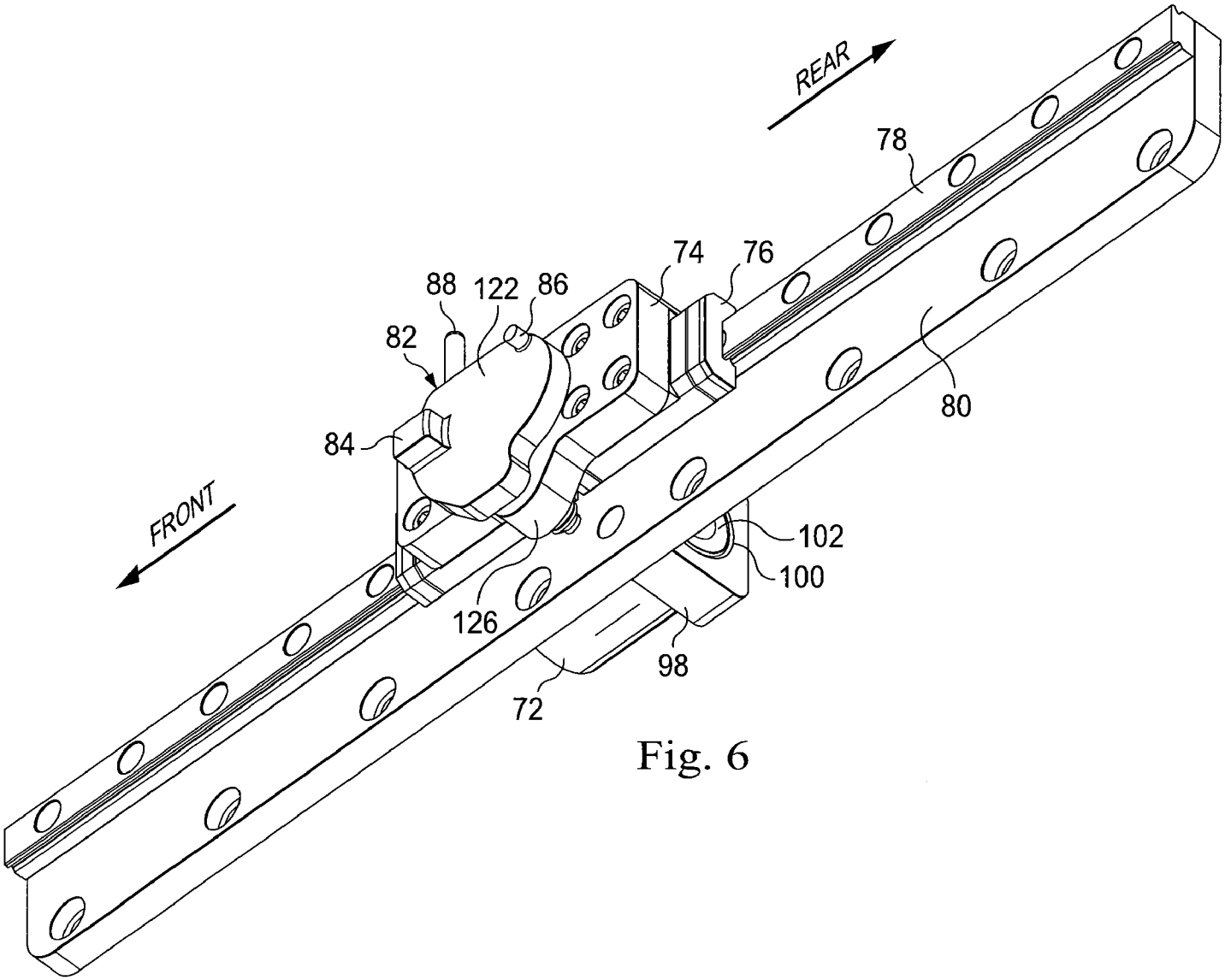
FIGS. 6 and 7 are perspective views of a hook/stage/.slider subassembly portion of the charger illustrating its connection to a mount plate/rail subassembly portion of the charger.
Figure 7:
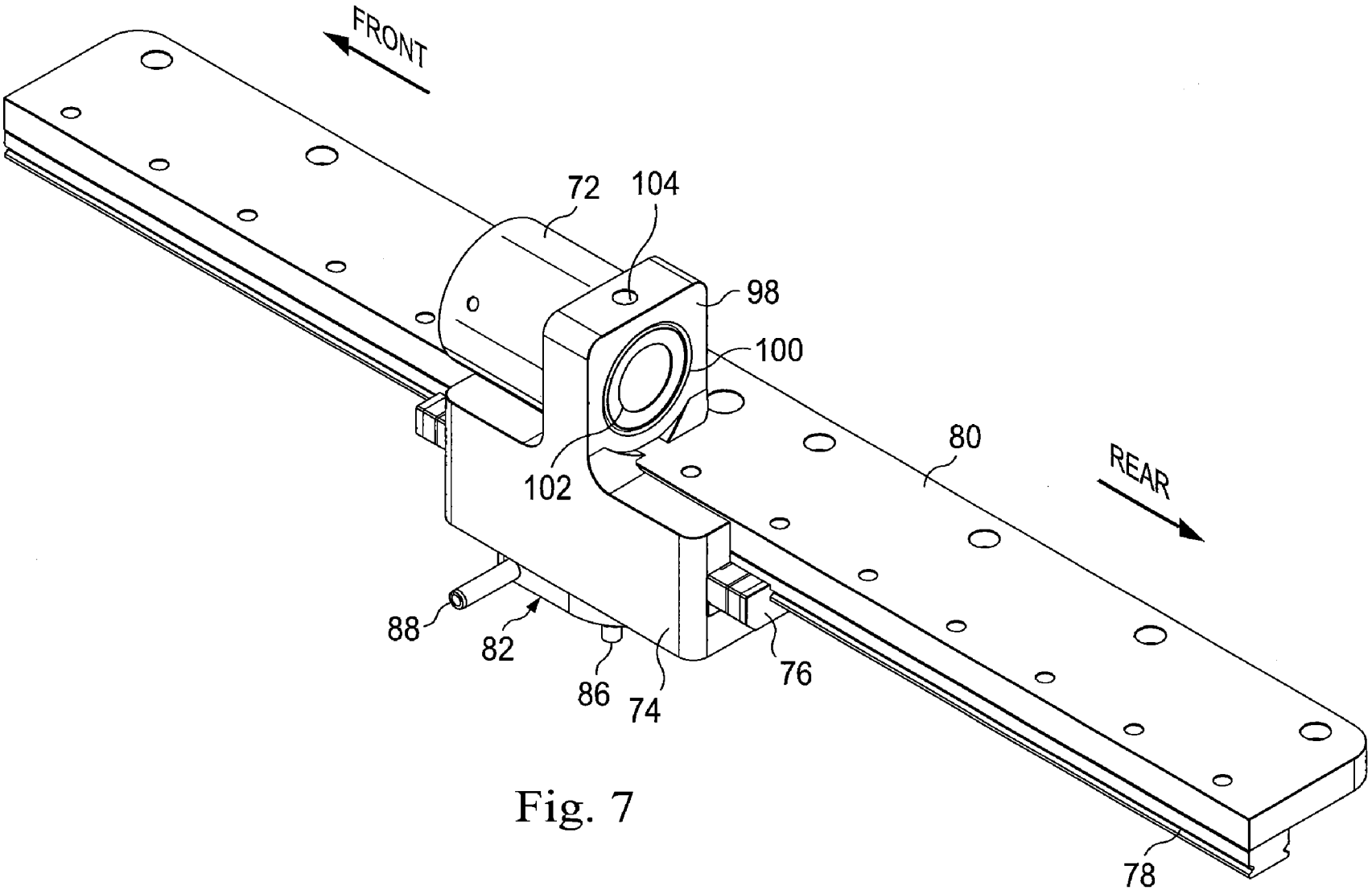

The charger operating components disposed within the housing 38 are perspectively illustrated in FIG. 5 and include an elongated ball screw 70 longitudinally extending forwardly and rearwardly through the interior of the housing 38, with the front end of the screw being anchored to the rotatable knob 60, and the rear end of the screw being drivably coupled to the motor 52. A ball nut 72 is threaded onto the screw 70, for forward or rearward driven rotation in response to rotation of the screw, and is fixedly secured to a stage structure 74 which, in turn, is anchored to a slider member 76 that slides forwardly and rearwardly along a horizontally elongated profile rail 78 mounted on a horizontally elongated mount plate 80 anchored within the interior of the housing 38. Perspective detail views of the interconnected ball nut 72, stage structure 74, slider member 76, profile rail 78 and mount plate 80 are shown in FIGS. 6 and 7.

With reference now to FIGS. 5-9, a bolt pin engagement and drive structure in the form of a generally plate-shaped hook member 82 is carried on an outwardly facing side portion of the stage 74 for rotation relative thereto about a horizontal axis perpendicular to the ball screw 70. On its outer side the hook member 82 has an outwardly projecting bolt pin engagement block 84 and a short outwardly projecting pin 86. Projecting outwardly from an edge of the hook member 82 is a longer pin member 88. Elongated rectangular front and rear stop members 90,92 (see FIG. 5) respectively project inwardly from the front and rear housing end walls 48 and 50, with the front stop member 90 having a rear end 94, and the rear stop member 92 having a front end 96. As can be seen, motor-driven rotation of the ball screw 70 in an appropriate direction can drive the stage 74, the slider 76 and the hook member 82 either forwardly or rearwardly within the charger housing 38. Alternatively, the adjustment knob 60 (see FIG. 1) can be used to manually turn the ball screw 70 in selectively opposite rotational directions if desired.

Stage structure 74, as best illustrated in FIGS. 6-9, has a generally U-shaped configuration, straddles the interconnected profile rail 78 and mount plate 80, and has a flange portion 98 with a threaded opening 100 therein into which a threaded end 102 of the ball nut 72 is threaded. Ball nut end 102 is releasably retained in the opening 100 by means of a set screw 104 received in a side wall opening 106 in the flange 98.

Figure 8:
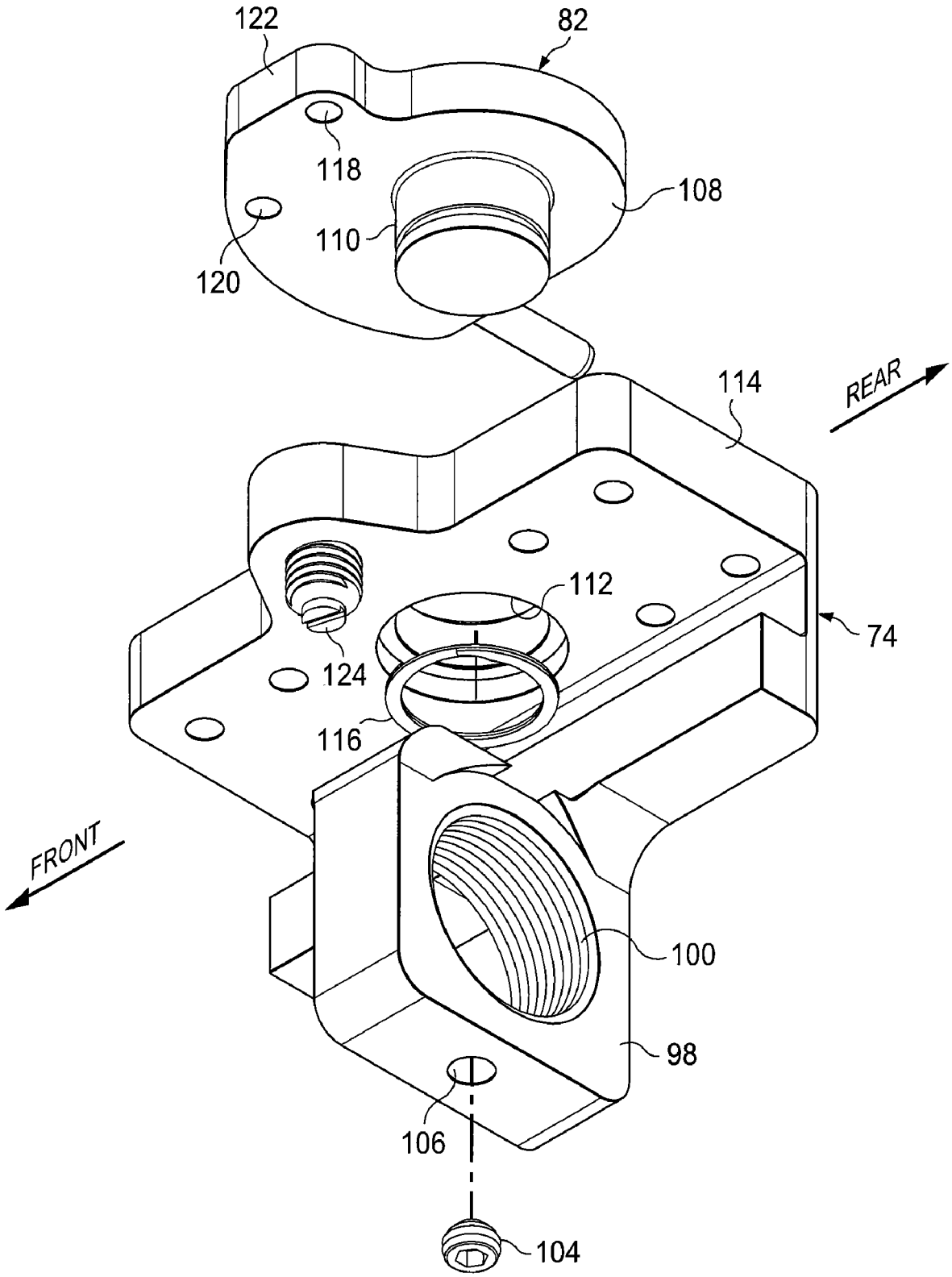
FIGS. 8 and 9 are enlarged scale exploded perspective views of the hook and stage portions of the charger.
Figure 9:
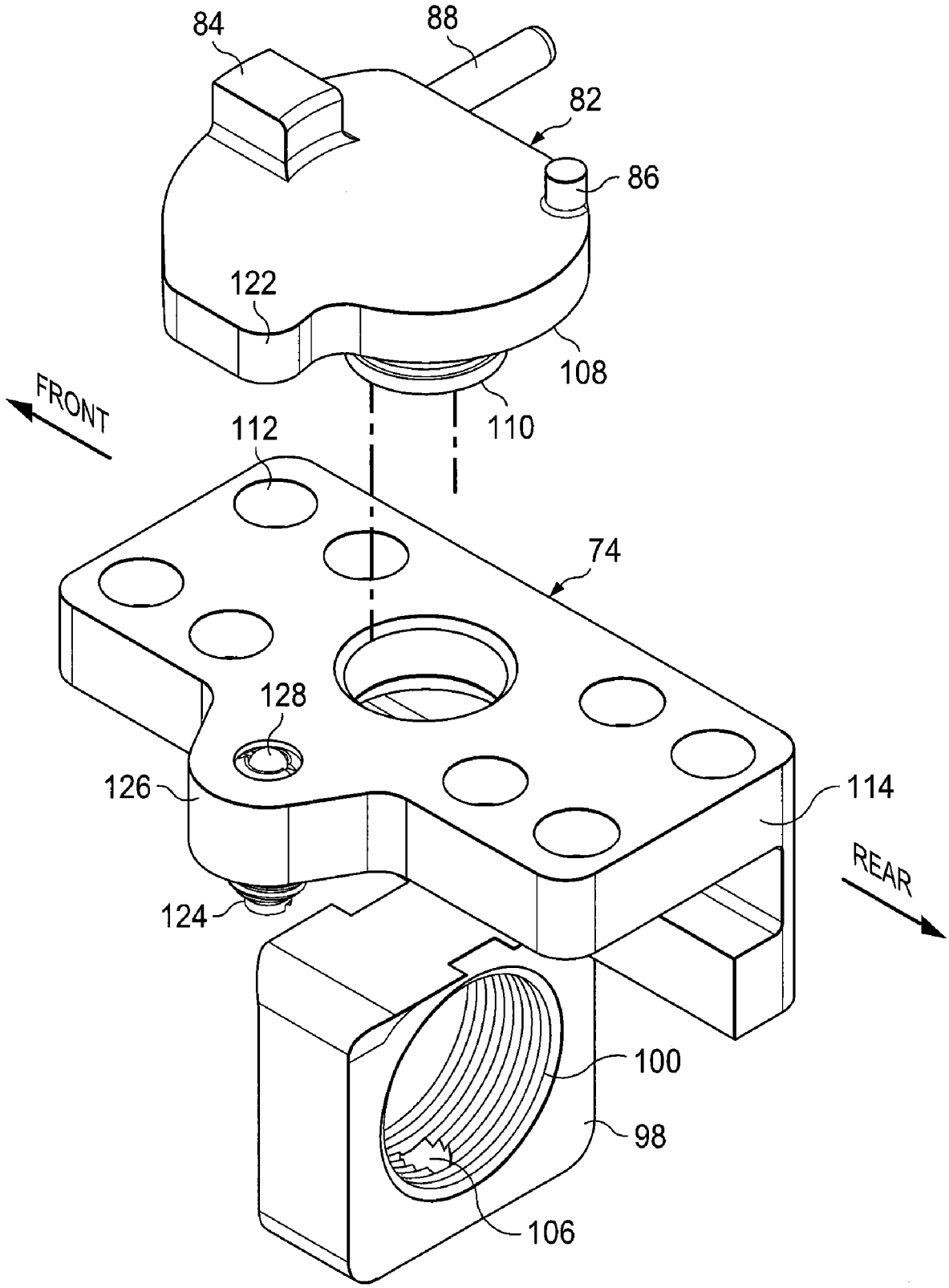

Turning now to FIGS. 8 and 9, the hook member 82, on its inner side 108, a downwardly projecting cylindrical boss 110 rotatably received in a corresponding circular hole 112 formed in a top wall 114 of the stage structure 74, the boss 110 being captively retained in the hole 112 using a snap-on spiral retaining ring 116. The hook member 82 is rotatable relative to the top wall 114 of the stage structure 74, about the axis of the cylindrical boss 110, between releasably retained first and second rotational positions relative to the stage structure 74. This releasable retention is achieved by means of two detent recesses 118,120 formed on the underside 108 of the hook member 82 on a lobe portion 122 (see FIG. 8) in cooperation with a ball spring plunger assembly 124 extending through a lobe portion 126 of the top wall 114 of the stage structure 74 and having a spring-loaded top end ball 128 (see FIG. 9).

Under the management of a control system 130 (schematically depicted in FIG. 4 and subsequently described herein) the forward and rearward movement of the hook member portion 82 may be remotely controlled, thus controllably moving the machine gun bolt pin 18 between "safe" and "armed" positions as will now be described with reference to FIGS. 3A-3F.

Figure 3A:
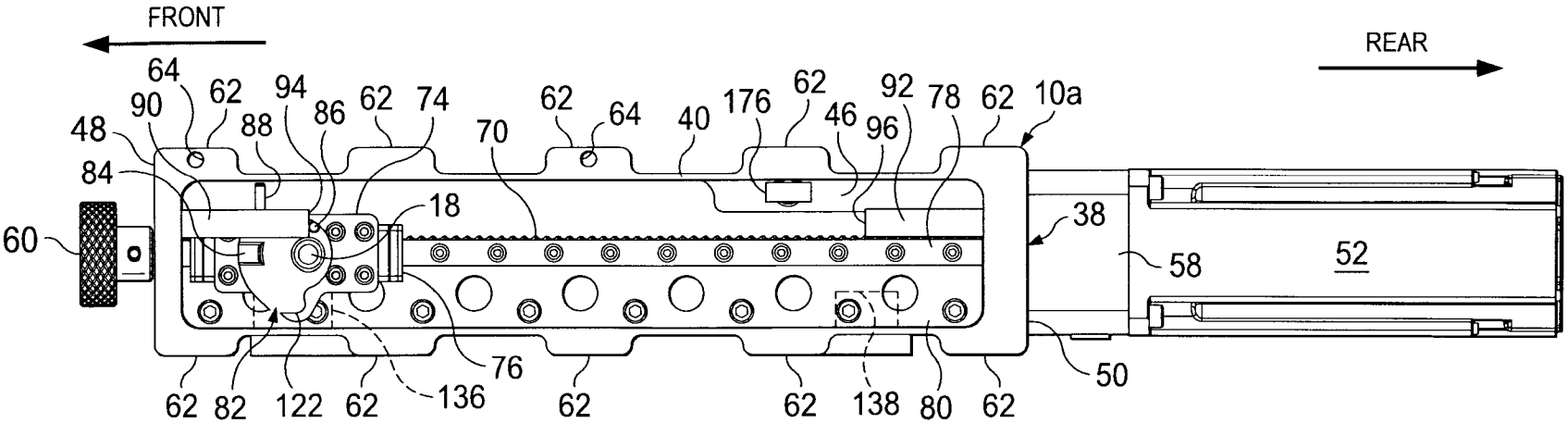
FIGS. 3A-3F are inner side elevational views of the removed portion of the charger, taken along line 3-3 of FIG. 2, and sequentially illustrate the controlled movement by the charger of the machine gun bolt pin between its armed and safe positions.

For purposes of description it will be assumed that the bolt pin 18 is initially in its forwardmost "armed" position as shown in FIG. 3A. In this position of the bolt pin 18, hook member 82 is in its forwardmost translational limit position, and its first detent-retained rotational position in which the pin 88 is in a vertical orientation in which it extends upwardly from the body of the hook member 82. The small hook member pin 86 bears against the rear end 94 of the front stop member 90, and the hook member engagement block 84 is disposed somewhat forwardly of the bolt pin 18.

Figure 3B:
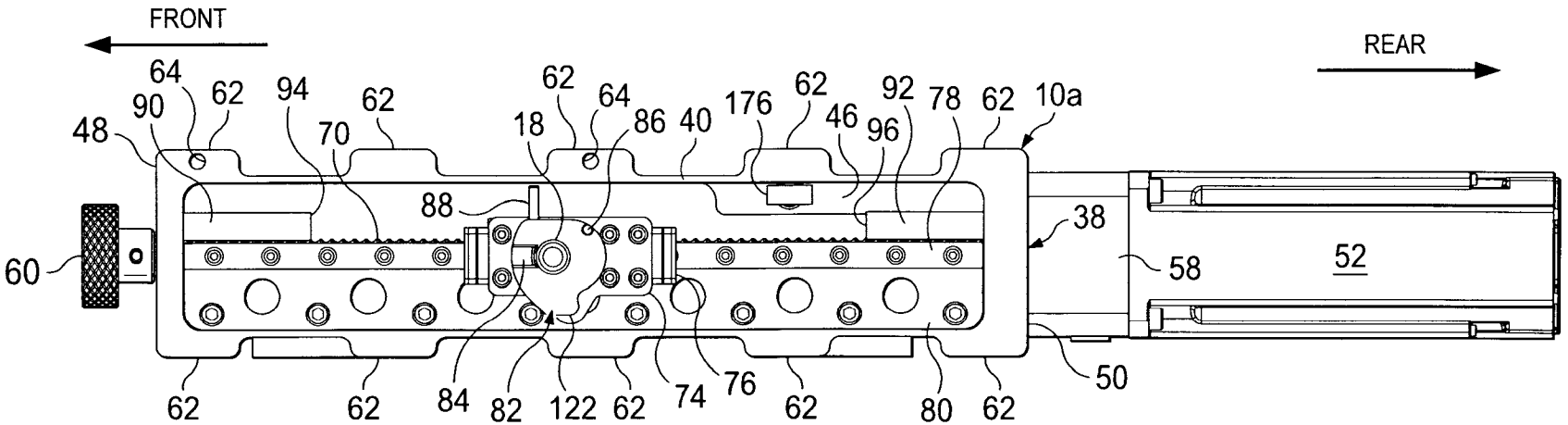
Figure 3C:
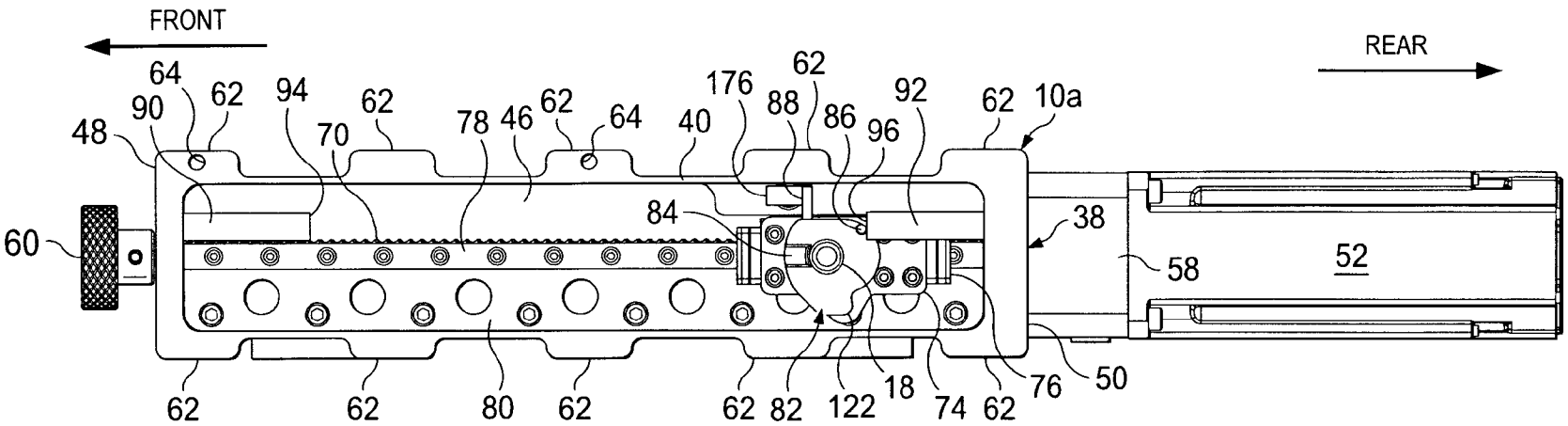

When it is desired to move the bolt pin 18 rearwardly to its "safe" position, the charger motor 52 is used to appropriately rotate the ball screw 70 to rearwardly drive the hook member 82. During an initial portion of the driven rearward travel of the hook member 82 (which is still in its first rotational position), its engagement block portion 84 contacts the bolt pin 18 and drives it rearwardly as shown in FIG. 3B. As shown in FIG. 3C, when the bolt pin 18 rearwardly reaches its "safe" position, motor operation is terminated with the bolt pin 18 still forcibly engaged with the hook member block 84 (due to the operation of the bolt spring), the hook member 82 still in its first rotational position, and the hook member pin 86 disposed just forwardly of the front end 96 of rear stop member 92. In this "safe" orientation of the bolt pin 18, the machine gun 16 is prevented from firing until returned to its FIG. 3A "armed" position.

Figure 3D:
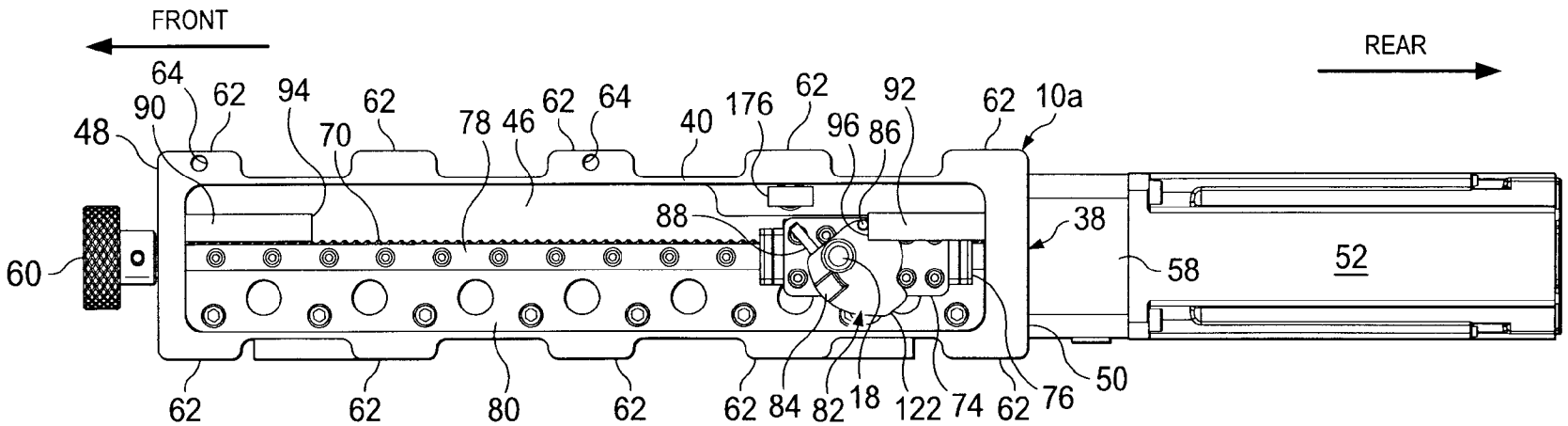
Figure 3E:
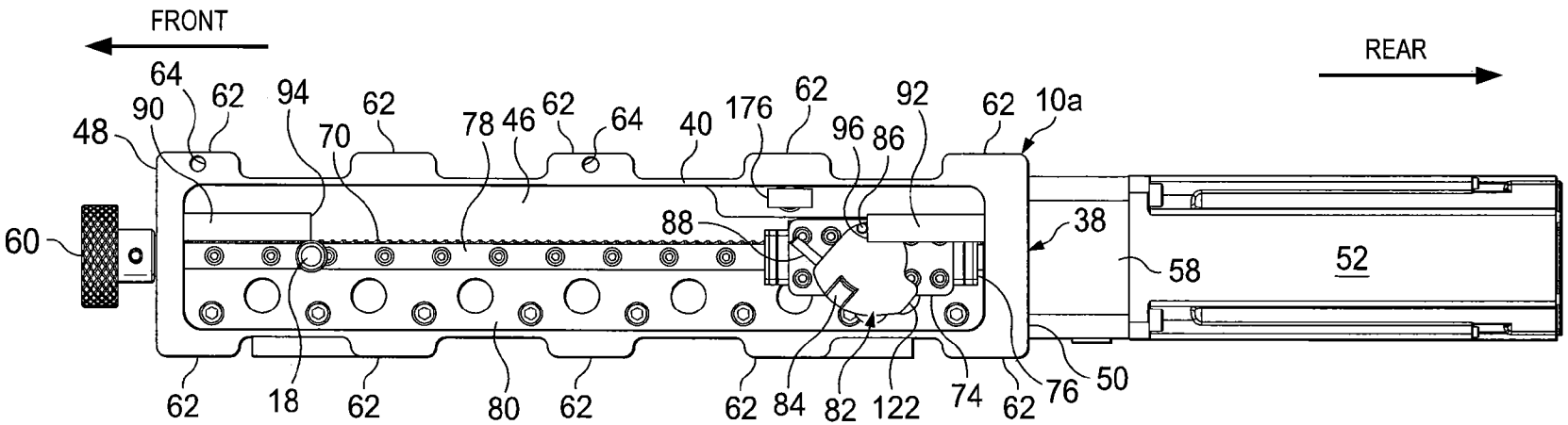

When it is desired to return the bolt pin 18 from its FIG. 3C "safe" orientation to its FIG. 3A "armed" orientation, the motor 52 is used to drive the hook member 82 rearwardly past its "safe" orientation as shown in FIG. 3D. As shown in FIG. 3D, this causes the rearwardly traveling hook pin 86 to be forcibly engaged by the front surface 96 of the rear stop member 92 to thereby rotate the hook member 82 in a counterclockwise direction away from its detent-retained first position. Such rotation moves the hook member block 84 out of forwardly blocking engagement with the bolt pin 18, thereby permitting the bolt pin spring to snap the bolt pin 18 forwardly back to its "armed" position shown in FIG. 3E as the hook member 82 continues to be driven a short distance rearwardly until the rear stop member 92 further pivots the hook member 82 in a counterclockwise direction to its detent-retained second position as shown in FIG. 3E.

Figure 3F:
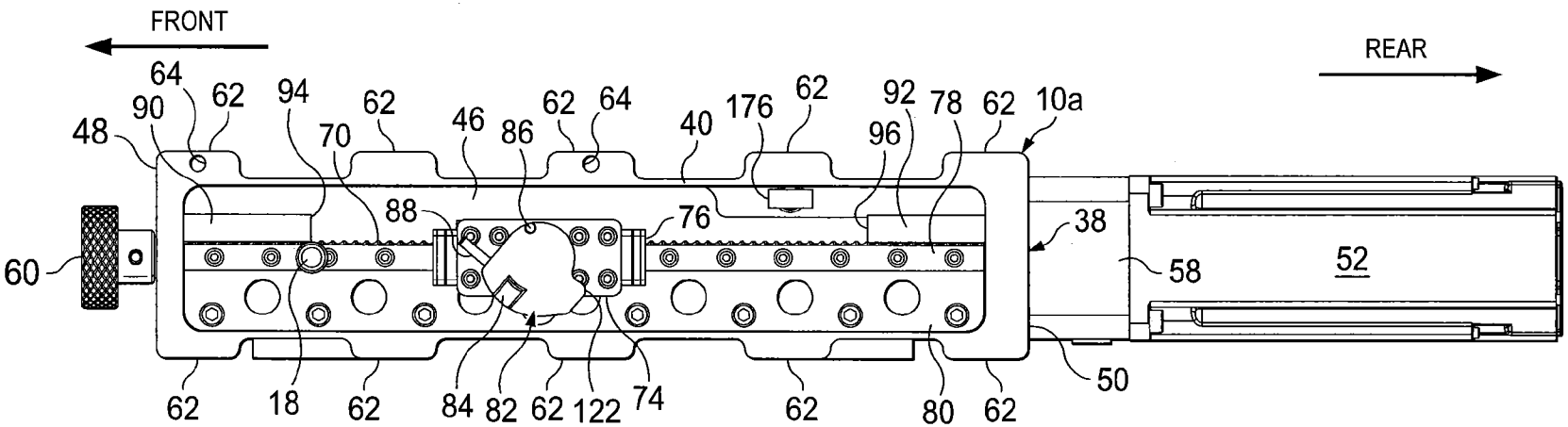

Next, as shown in FIG. 3F, the hook member 82, still in its second rotational position, is screw-driven forwardly through the interior of the charger body housing 38. As it approaches the bolt pin 18, the rear end 94 of the forward stop member 90 engages the hook member pin 88 to thereby rotate the hook member 82 in a clockwise direction back to its detent-retained first rotational position in which, as shown in FIG. 3A, the hook member engagement block 84 is spaced forwardly apart from the bolt pin 18 in its "armed" position.

It should be noted that with the hook member 82 in its second rotational position the engagement block 84 is disposed beneath the reciprocating front-to-rear travel path of the bolt pin 18, the hook member pin 86 is disposed above such travel path, and the body of the hook member 82 and the hook member pin 88 are interposed between the outer end of the bolt pin 18 and the outer side wall 46 of the charger body housing 38. Accordingly, as soon as the bolt pin 18 is released from the contact with the engagement block 84 (as shown in FIG. 3D) the bolt pin 18 is free to be spring-returned to its "armed" position (see FIG. 3E) and the machine gun 16 can be fired—even while the hook member 82 is being returned forwardly to its FIG. 3A position. Stated in another manner, firing of the gun is not delayed until the hook member 82 returns to its FIG. 3A position. As subsequently described herein, the hook member 82 may alternatively be screw-driven (in a "recocking" sequence) from its FIG. 3A position to its FIG. 3E position without being temporarily held in its FIG. 3C "safe" position.

Figure 4:
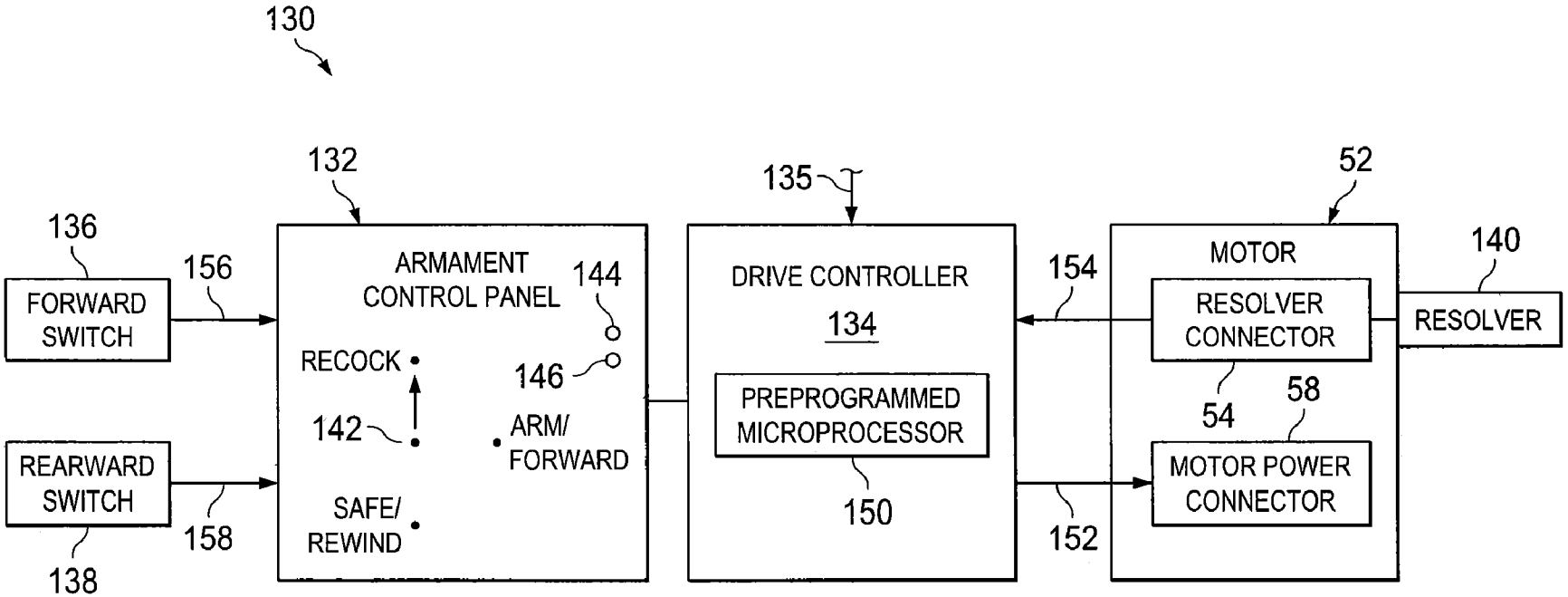
FIG. 4 is a schematic diagram of a control system operatively associated with the gun charger.

Turning now to FIG. 4, the previously mentioned control system 130 includes an armament control panel 132, a drive controller 134, forward and rearward position switches 136 and 138, and a resolver portion 140 of the electric drive motor. Armament control panel 132 has a selector switch portion 142 which may selectively rotated among "recock", "arm/fwd" and safe/rwd" positions, a forward position indicating light 144, and a rearward position indicating light 146. Armament control panel 132 is coupled to a preprogrammed microprocessor portion 150 of the drive controller 134 which, in turn, is powered via an electrical power supply lead 135. Upon receipt of a signal indicative of the selected position of the armament control panel switch 142, the drive controller 134, under the control of the microprocessor 150, transmits electrical power to the motor power connector 58 via a lead 152 to appropriately drive the bolt pin hook member 82. The resolver portion 140 of the motor 52 measures motor speed, rotational direction and number of revolutions, and transmits to the drive controller 134, via the resolver connector 54 and a feedback lead 154, motor operational data that permits the microprocessor 150 to appropriately start, stop and otherwise control the motor 52.

Positional information with respect to the hook member 82 is generated by the forward and rearward switches 136 and 138 which are schematically depicted in phantom in FIG. 3A. When the hook member 82 is in its forward "armed" position, a bottom side portion of the stage structure 74 depresses the forward switch 136 which responsively transmits a position confirmation signal 156 to the armament control panel 132 and also causes the forward position indicator light 144 thereon to be illuminated. When the hook member 82 is in its rearward "safe" position, a bottom side portion of the stage structure 74 depresses the rearward switch 138 which responsively transmits a position confirmation signal 158 to the armament control panel 132 and also causes the rearward position indicator light 146 thereon to be illuminated.

Figure 10A:
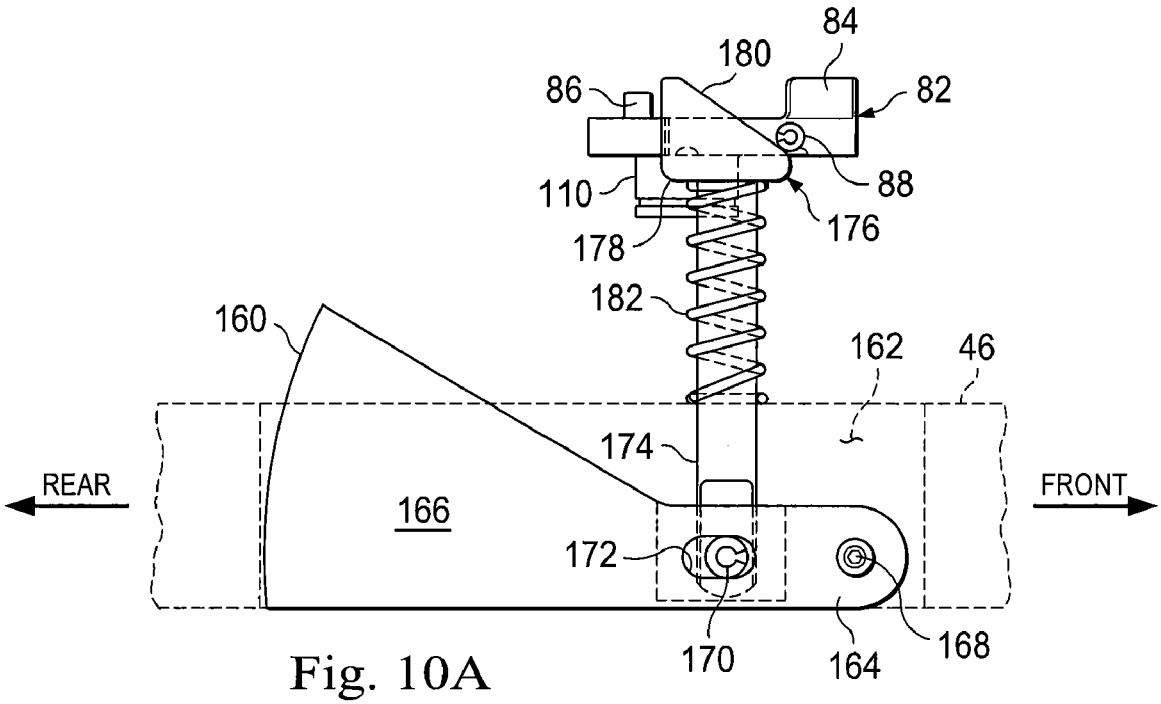
FIGS. 10A and 10B are enlarged scale top plan views of a hook-operated bolt pin position indicating flag structure portion of the charger sequentially illustrating its operation.
Figure 10B:
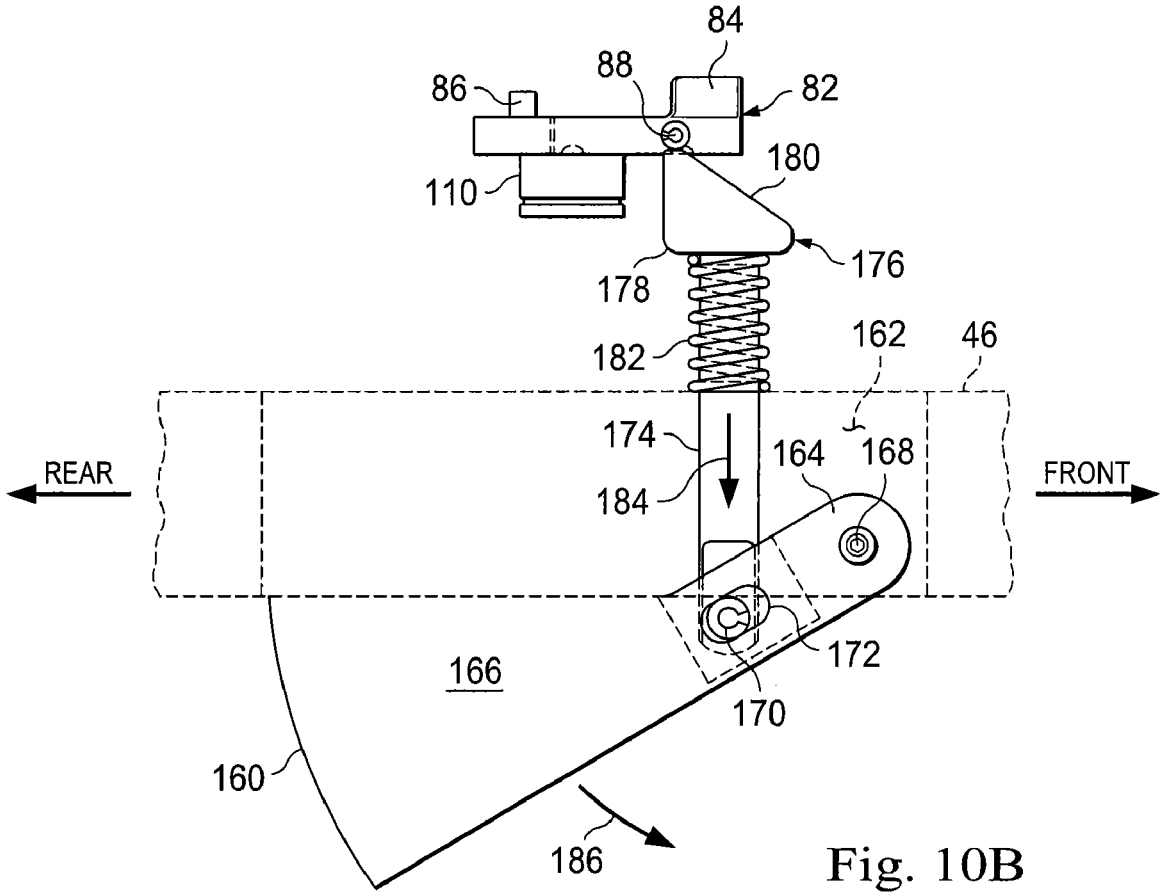
Figure 11:
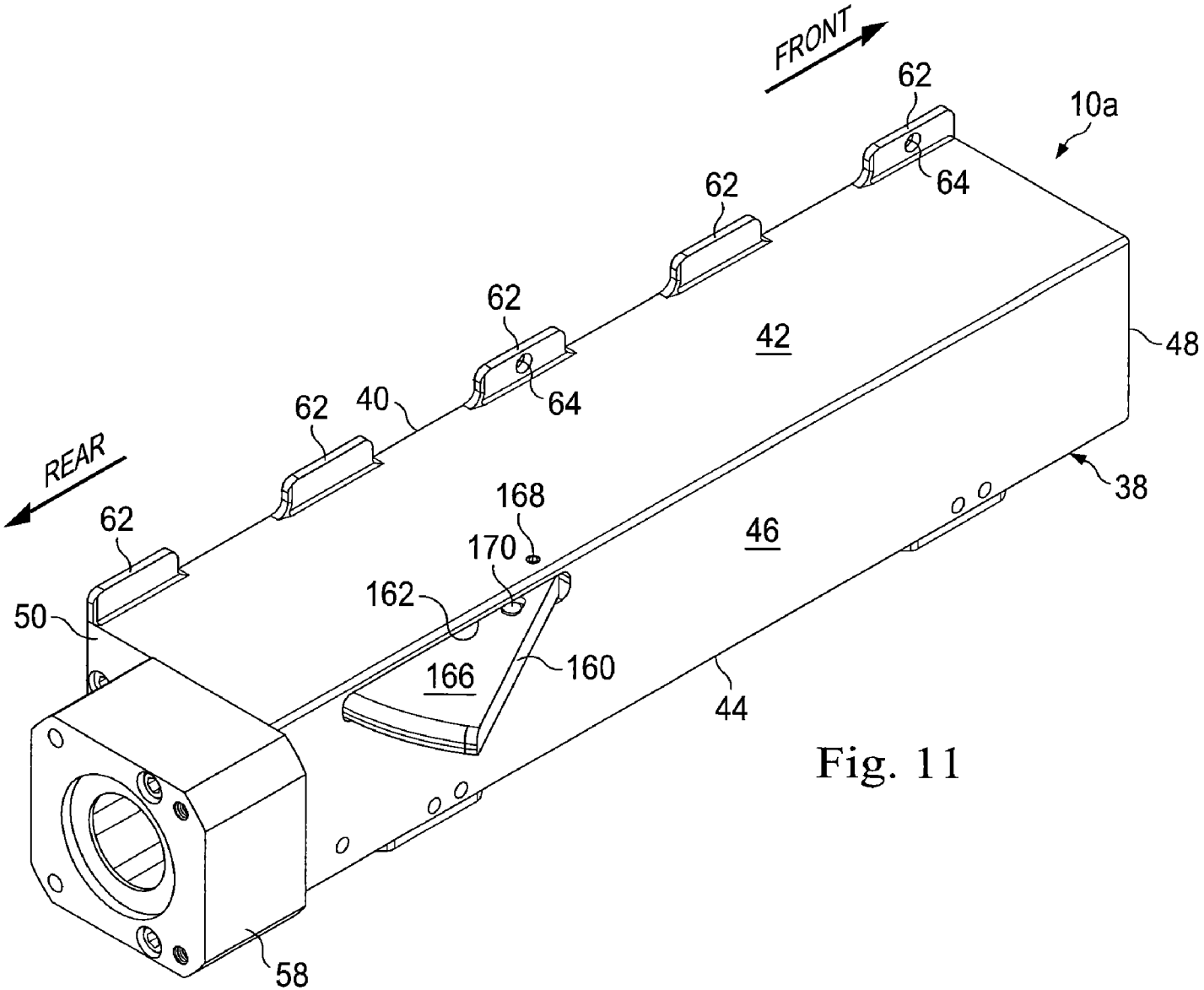
FIG. 11 is an outer side perspective view of the charger housing showing the flag projecting outwardly from a slot in its outer side wall.

With reference now to FIGS. 10A, 10B and 11, in addition to the positional indicia provided by the switches 136 and 138 and their associated indicating lights 144 and 146, the charging system also provides a user thereof with a visual indication on the charger body housing 38 that the bolt pin 18 is in its rearwardly disposed "safe" position. An elongated, generally plate-shaped flag member 160 is carried in a slot 162 formed in the outer side wall 46 of the charger body housing 38 and has a narrow front end 164 and a wider rear end 166. The front end 164 is pivotally connected to the wall 46 by a vertical pin 168 that permits the rear end 166 of the flag 160 to horizontally swing into and out of the slot 162 as may be seen by comparing FIGS. 10A to FIGS. 10B and 11.

Another vertical pin 170 is received in a lost motion slot 172 extending through the flag member 160, and is also secured to the outer end of a horizontally oriented rod 174 extending into the slot 162. Secured to the inner end of the rod 174 is a ramp member 176 (see also FIGS. 3A-3F and 5) having an outer side surface 178 and a ramped inner side surface 180. Circumscribing the rod 174 is a coil spring 182 that bears at its opposite ends against the inner side surface of the housing wall 46 and the outer side surface 178 of the ramp member 176 and resiliently biases the ramp member 176 in an inward direction (i.e., in an upward direction as viewed in FIGS. 10A and 10B).

As the hook member 82 rearwardly approaches its "safe" position, its pin 88 initially engages the ramped surface 180 as shown in FIG. 10A, and then, as shown in FIG. 10B, cams the ramp member 176 outwardly, against the resilient force of the now compressed spring 182, to thereby pivot the flag member 160 outwardly through the wall slot 162 as indicated by the arrows 184,186 in FIG. 10B, thereby providing a visual indicia (see also FIG. 11), on the exterior of the charger body housing 38, that the bolt pin 18 is in its "safe" position.

Compared to the machine gun charging apparatus illustrated and described in U.S. Pat. No. 4,974,499 the gun charger 10 of the present invention and its associated remote control system 130 provide a variety of advantages. For example, the gun charger 10 is smaller and lighter, and has considerably fewer parts. Additionally, in the charger 10 when the bolt pin is released from its safe position it is spring-driven back to its armed position substantially instantaneously by the bolt spring without waiting for the pin engagement and drive structure to be returned to its forwardmost position.

Moreover, the gun may be fired during such movement of the engagement and drive structure back to its forwardmost position. Also, the charger 10 may be mounted on and removed from the machine gun without the use of tools, or the necessity of removing or adjusting any of the internal components of the machine gun.

A variety of modifications may be made to the previously described gun charger 10 without departing from principles of the present invention. Several of such potential modifications are representatively illustrated in FIGS. 12-15.

Figure 12:
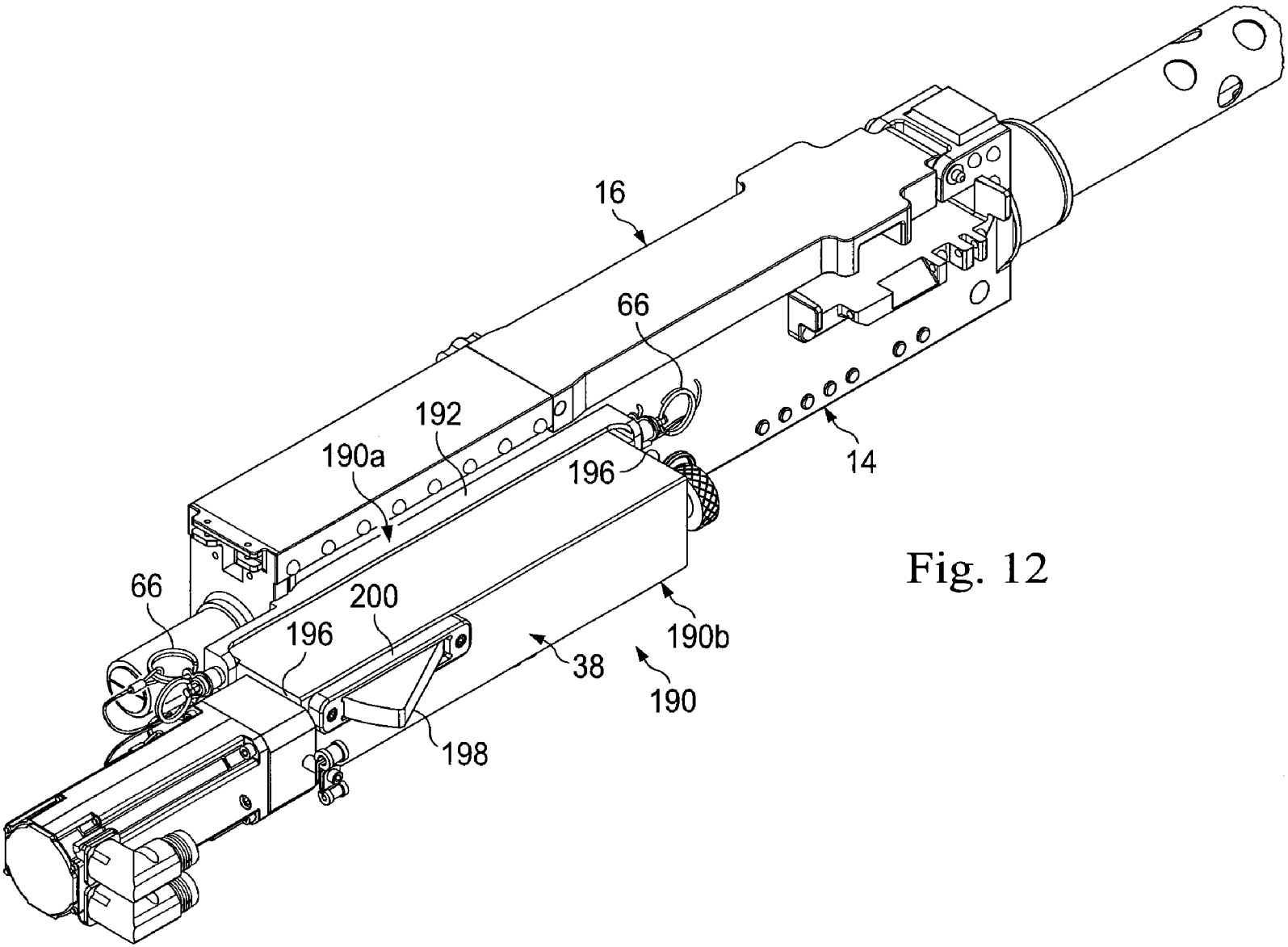
FIG. 12 is a perspective view of the FIG. 1 machine gun with an alternative embodiment of the remotely operable gun charger operatively mounted thereon.
Figure 13:
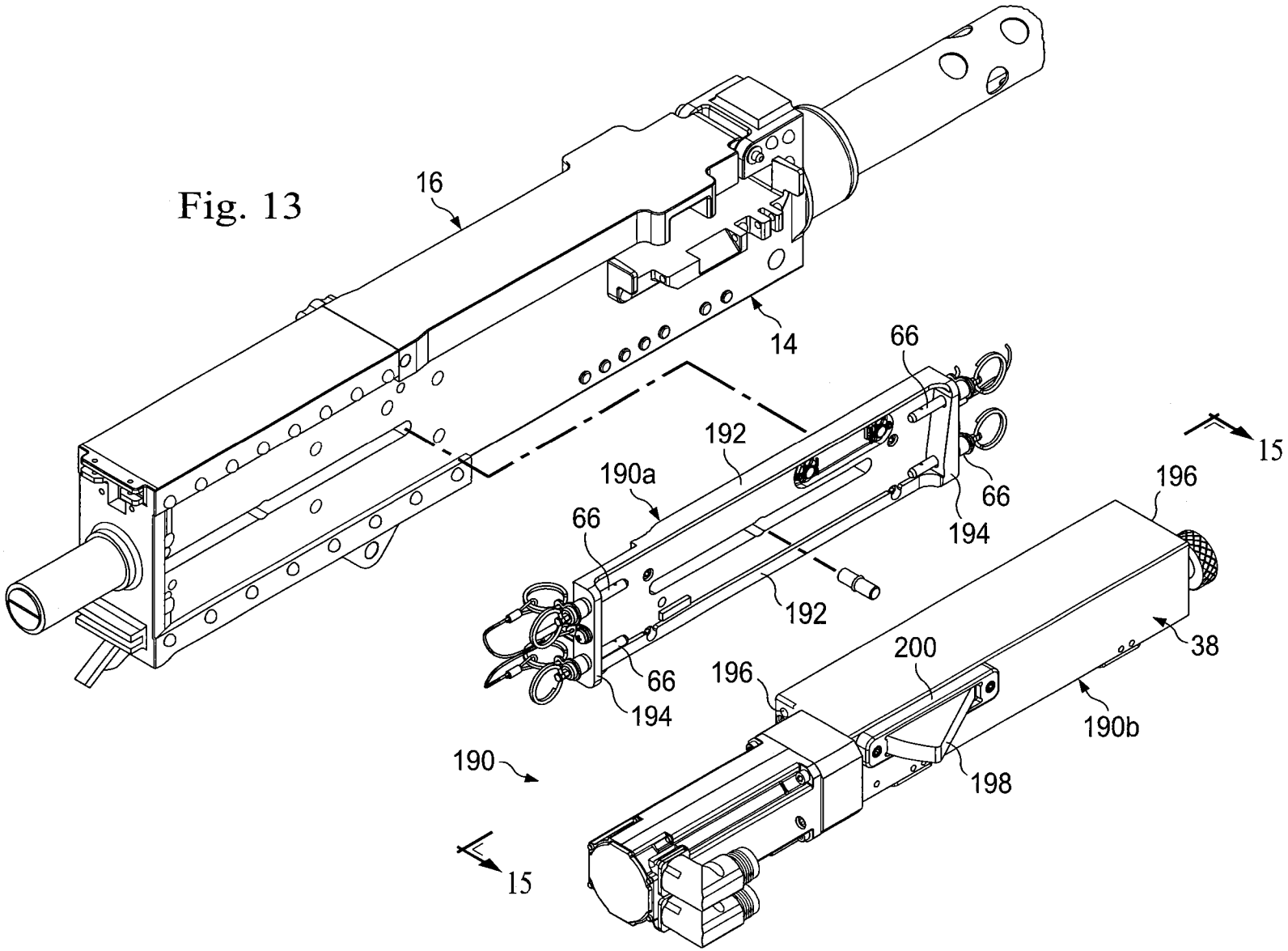
FIG. 13 is a partially exploded view similar to that of FIG. 12, but with the charger housing and its internal components removed from the mounting plate portion of the charger.

For example, an alternate embodiment 190 of the previously described gun charger 10 (see FIGS. 1 and 2) is shown in FIGS. 12 and 13 and comprises a revised charger mounting plate portion 190*a* and a revised charger body portion 190*b*. Mounting plate portion 190*a* is removably securable to the gun body 14 and has a horizontally elongated rectangular configuration, with outwardly extending side edge projections 192 and outwardly extending end edge projections 194. To removably secure the body portion 190*b* to the mounting plate portion 190*a*, without the use of tools, the horizontally elongated rectangular charger body 38 is inwardly nested within the generally frame-shaped outer side recess of the mounting plate portion 190*a* (collectively defined by the side edge projections 192 and 194) and removably secured to the plate portion 190*a* using four ball pins 60. As illustrated in FIGS. 12 and 13, two of the ball pins 66 are extended inwardly through each of the mounting plate end edge projections 194 and the underlying end wall 196 of the charger body 38 through aligned mounting holes in the projections 194 and body end walls 196.

Figure 14:
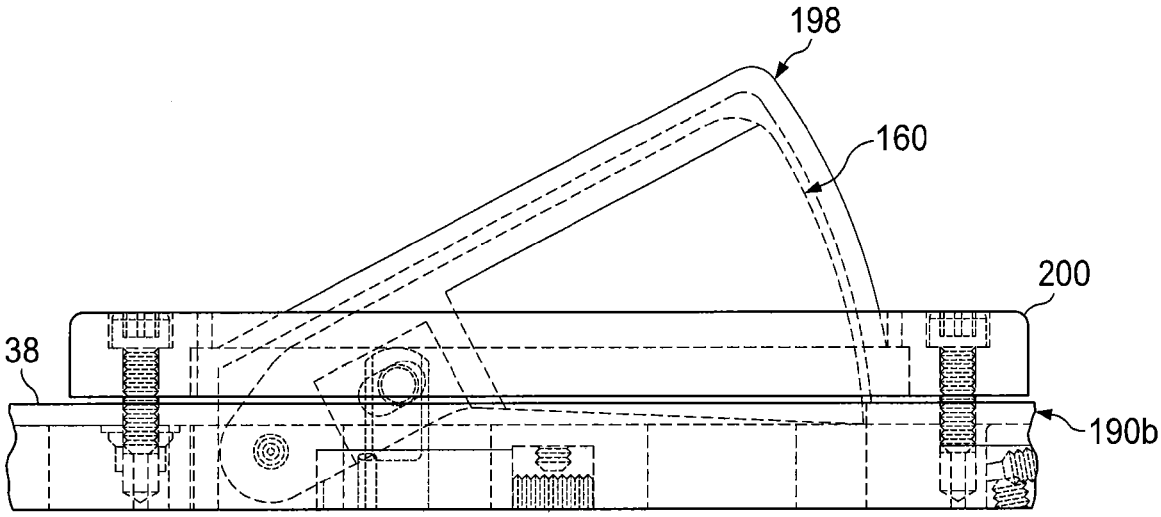
FIG. 14 is an enlarged scale top plan view of a portion of the FIG. 13 charger illustrating a protective flag housing structure projecting outwardly from its outer side.

Turning now to FIG. 14, the previously described bolt pin position indicator flag member 160 (see FIGS. 10A-11) may be provided with a protective clear plastic shroud member 198 (see also FIGS. 12 and 13) which is mounted on a rectangular support frame 200 suitably secured externally to the horizontally outer side surface of the gun charger body portion 190*b* around the opening therein through which the flag member 160 outwardly projects. The shroud member 198 protects the flag member 160 from damage, and also seals around its associated charger body opening to prevent dust, dirt and the like from entering the interior of the charger body 38 therethrough.

Figure 15:
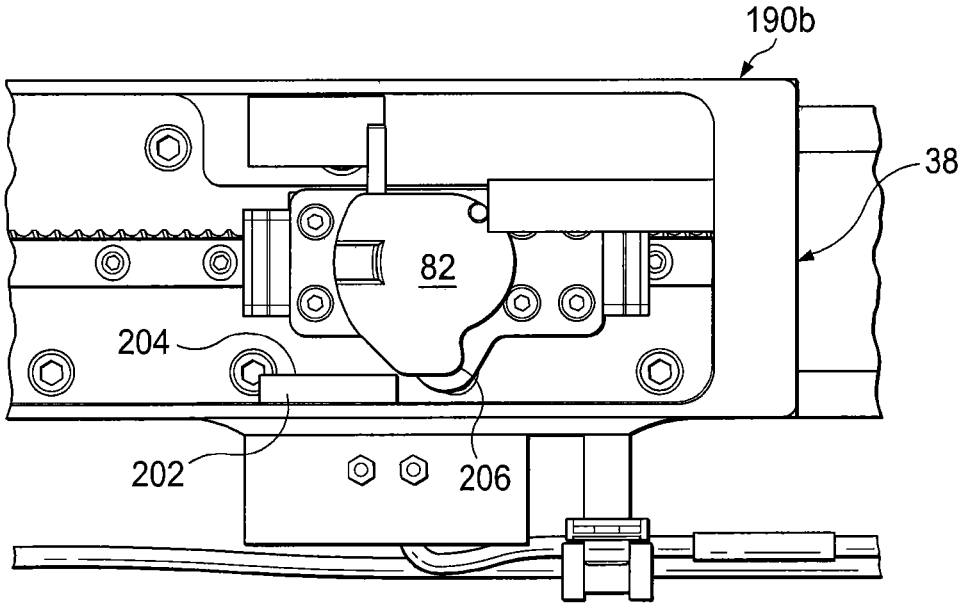
FIG. 15 is an enlarged scale inner side elevational view of the removed charger of FIG. 13, taken generally along line 15-15 of FIG. 13, illustrating a striker plate member operatively disposed within the charger.

Additionally, with reference now to FIG. 15, the interior of the gun charger body portion 190*b* may be provided with a small striker plate member 202 suitably secured to the interior surface of the bottom side wall of the body 38 adjacent its right end as viewed in FIG. 15. The planar top side surface 204 of the striker plate member 202 is positioned a small distance below a flat surface area 206 of the previously described hook member 82 which is horizontally disposed and faces downwardly as the hook member 82 rightwardly travels past the striker member 202. As the hook member 82 passes rightwardly across the striker plate member 202, the upper surface 204 of the striker plate member 202 functions to block undesirable counterclockwise rotation of the hook member 82 (by forming an underlying barrier to the tilting of its flat surface 206) until the hook member flat surface 206 rightwardly passes the striker plate member 202.

The foregoing detailed description is to be clearly understood as being given by way of illustration and example only, the spirit and scope of the present invention being limited solely by the appended claims.

What is claimed is:

1. Gun charging apparatus for selectively causing movement of a machine gun bolt pin between safe and armed positions thereof, the bolt pin having a return spring biasing it toward said armed position, said gun charging apparatus comprising:

an actuating member supported for driven movement between a first position, a second position spaced apart from said first position, and a third position spaced further apart from said first position than said second position; said actuating member being:

(1) operative to engage said bolt pin, drive said bolt pin to said safe position, at a limit location of said bolt pin and then hold said bolt pin in said safe position against the biasing force of said return spring, in response to said actuating member being driven from said first position to said second position, (2) operative to release said bolt pin and permit said bolt pin spring to drive said bolt pin back to said armed position in response to said actuating member being driven from said second position to said third position, said actuating member in said third position thereof being translated relative to said limit location of said bolt pin in said safe position thereof, (3) operative to drivingly re-engage said bolt pin, after said actuating member is driven from said third position to said first position, in response to said actuating member again being driven from said first position towards said second position, and (4) configured to permit said bolt pin to return to its armed position, and reciprocate during firing of the machine gun, during driven return of said actuating member from its third position to its first position; and drive apparatus operable to drive said actuating member to said first, second and third positions.

2. The gun charging apparatus of claim 1 wherein:

said drive apparatus includes a control system operable to remotely control the movement of said actuating member.

3. The gun charging apparatus of claim 2 wherein:

said actuating member is drivable among said first, second and third positions along an axis, and said gun charging apparatus further comprises position indicating apparatus for creating at least one visible signal indicative of the position of said actuating member along said axis.

4. The gun charging apparatus of claim 3 wherein:

at least one visible signal is generated by an indicating light.

5. The gun charging apparatus of claim 3 wherein:

at least one visible signal is created using an indicating member movable between first and second positions when engaged by said actuating member.

6. The gun charging apparatus of claim 5 wherein:

said actuating member is carried within a hollow body with an exterior wall having an opening therein, and said indicating member is movable inwardly and outwardly through said opening in predetermined response to movement of said actuating member along said axis.

7. The gun charging apparatus of claim 6 further comprising:

a transparent shroud structure, externally carried on said exterior wall around said opening, for receiving said indicating member when it moves outwardly through said opening.

8. The gun charging apparatus of claim 2 wherein said control system is operable to selectively:

(1) hold said actuating member in said second position before permitting said drive apparatus to move said actuating member from said second position to said third position, and (2) cause said drive apparatus to move said actuating member directly from said first position to said third position.

9. The gun charging apparatus of claim 2 wherein:

said gun charging apparatus further comprises an electric motor operable to drive said actuating member to selected ones of said first, second and third positions thereof, and said control system includes a drive controller controllingly coupled to said electric motor and operative to receive an input signal indicative of a desired position of said actuating member, and a control panel useable to input said desired position signal to said drive controller.

10. The gun charging apparatus of claim 9 wherein:

said electric motor has a resolver portion operable to monitor the speed of said electric motor, the sensed motor speed being transmittable to said drive controller.

11. The gun charging apparatus of claim 1 wherein:

said drive apparatus comprises a rotational drivable screw member upon which said actuating member is carried for longitudinal movement relative to said screw member in response to driven rotation of said screw member.

12. The gun charging apparatus of claim 11 wherein:

said actuating member is carried on said screw member by a support structure mounted on a ball nut threadingly secured to said screw member.

13. The gun charging apparatus of claim 1 wherein:

said driven movement of said actuation member is along a first axis, and said actuating member is selectively rotatable relative to said screw member about a second axis transverse to said first axis.

14. The gun charging apparatus of claim 13 further comprising:

a rotation limiting structure for blocking rotation of said actuating member along a predetermined portion of its driven movement along said first axis.

15. The gun charging apparatus of claim 14 wherein:

said actuation member has a flat surface portion thereon, and said rotation limiting structure includes a striker block member having a flat surface thereon positioned to face said flat surface portion of said actuation member in a closely adjacent parallel relationship therewith while said actuation member travels along said predetermined portion of its driven movement along said first axis.

16. The gun charging apparatus of claim 13 wherein:

said actuating member in a first rotational orientation about said second axis is positioned to drivingly engage said bolt pin, and said actuating member in a second rotational orientation about said second axis is moved out of the reciprocating path of said bolt pin.

17. The gun charging apparatus of claim 16 further comprising:

a first stop structure operative to engage said actuating member and rotate it from said second rotational orientation to said first rotational orientation as said actuating member approaches said first position, and a second stop structure operative to engage said actuating member and rotate it from said first rotational orientation to said second rotational orientation as said actuating member approaches said third position.

18. The gun charging apparatus of claim 17 further comprising:

detent structures for releasably retaining said actuating member in said first and second rotational orientations.

* * * * *